350-96.23 SR
2/23/82 XR 4,317,000

United States Patent [19] [11] 4,317,000
Ferer [45] Feb. 23, 1982

[54] CONTRAHELICALLY LAID TORQUE BALANCED BENTHIC CABLE

[75] Inventor: Kenneth M. Ferer, Covington, La.

[73] Assignee: The United States of America as represented by the Secretary of the Navy, Washington, D.C.

[21] Appl. No.: 171,567

[22] Filed: Jul. 23, 1980

[51] Int. Cl.[3] ..... H01B 7/14; H01B 7/18

[52] U.S. Cl. ..... 174/70 R; 57/216; 57/230; 138/130; 138/137; 174/108; 174/120 R; 350/96.23

[58] Field of Search ..... 174/108, 116, 120 R, 174/120 SR, 121 R, 122 R, 70 R; 57/216, 230; 138/130, 137; 350/96.23

[56] References Cited

U.S. PATENT DOCUMENTS

| | | | |
|---|---|---|---|
| 2,604,509 | 7/1952 | Blanchard | 174/108 |
| 2,754,351 | 7/1956 | Horn | 174/108 X |
| 2,873,307 | 2/1959 | Horn | 174/120 R X |
| 2,953,627 | 9/1960 | Malneritch | 174/120 R X |
| 3,105,871 | 10/1963 | Eager | 174/105 |
| 3,177,901 | 4/1965 | Pierce | 138/130 |
| 3,376,378 | 4/1968 | Bullock | 174/107 |
| 3,604,461 | 9/1971 | Mathews | 138/130 X |
| 3,634,607 | 1/1972 | Coleman | 174/120 R |
| 3,842,584 | 10/1974 | Schmittman | 57/216 |
| 3,980,808 | 9/1976 | Kikuchi | 174/108 X |
| 4,010,619 | 3/1977 | Hightower | 174/28 X |
| 4,076,382 | 2/1978 | Oestreich | 350/96.23 |
| 4,097,686 | 6/1978 | Gladenbeck | 174/131 A |
| 4,259,544 | 3/1981 | Litauer | 174/120 R X |

FOREIGN PATENT DOCUMENTS

| | | | |
|---|---|---|---|
| 1024228 | 7/1980 | Canada . | |
| 2628069 | 8/1977 | Fed. Rep. of Germany | 350/96.23 |
| 2720071 | 11/1978 | Fed. Rep. of Germany | 174/120 R |
| 953833 | 4/1964 | United Kingdom | 138/137 |

*Primary Examiner*—Richard R. Kucia
*Attorney, Agent, or Firm*—Richard S. Sciascia; Harvey A. David

[57] ABSTRACT

A torque balanced cable for towing or suspending oceanographic instrumentation includes a data transmission core about which is wound a helically laid inner layer of load bearing strands formed of high tensile strength, low stretch aramid fiber and having a selected pitch angle, pitch diameter and strand thickness. An outer composite layer is contrahelically wound about the inner layer and an interposed, abrasion resisting barrier film layer, and includes alternating load bearing strands and non-load bearing filler strands, the other load bearing strands having the same degree of pitch angle and thickness as the inner strands and of a number that bears substantially the same ratio to the number of inner strands as the pitch diameter of the inner layer bears to the pitch diameter of the outer layer.

10 Claims, 2 Drawing Figures

FIG. 1
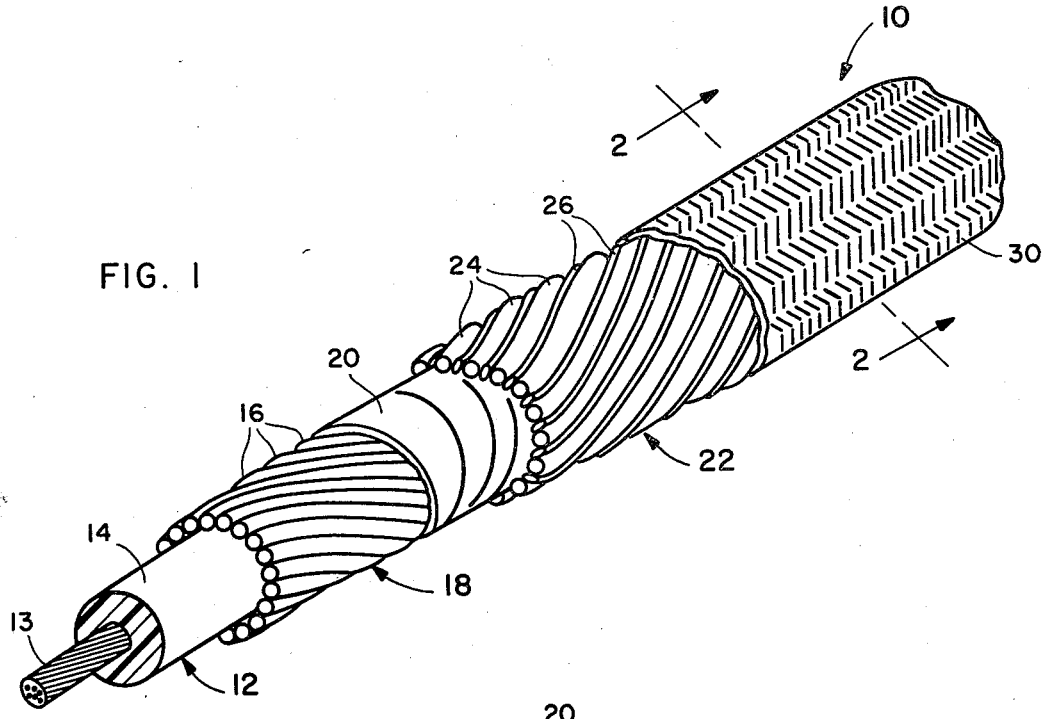
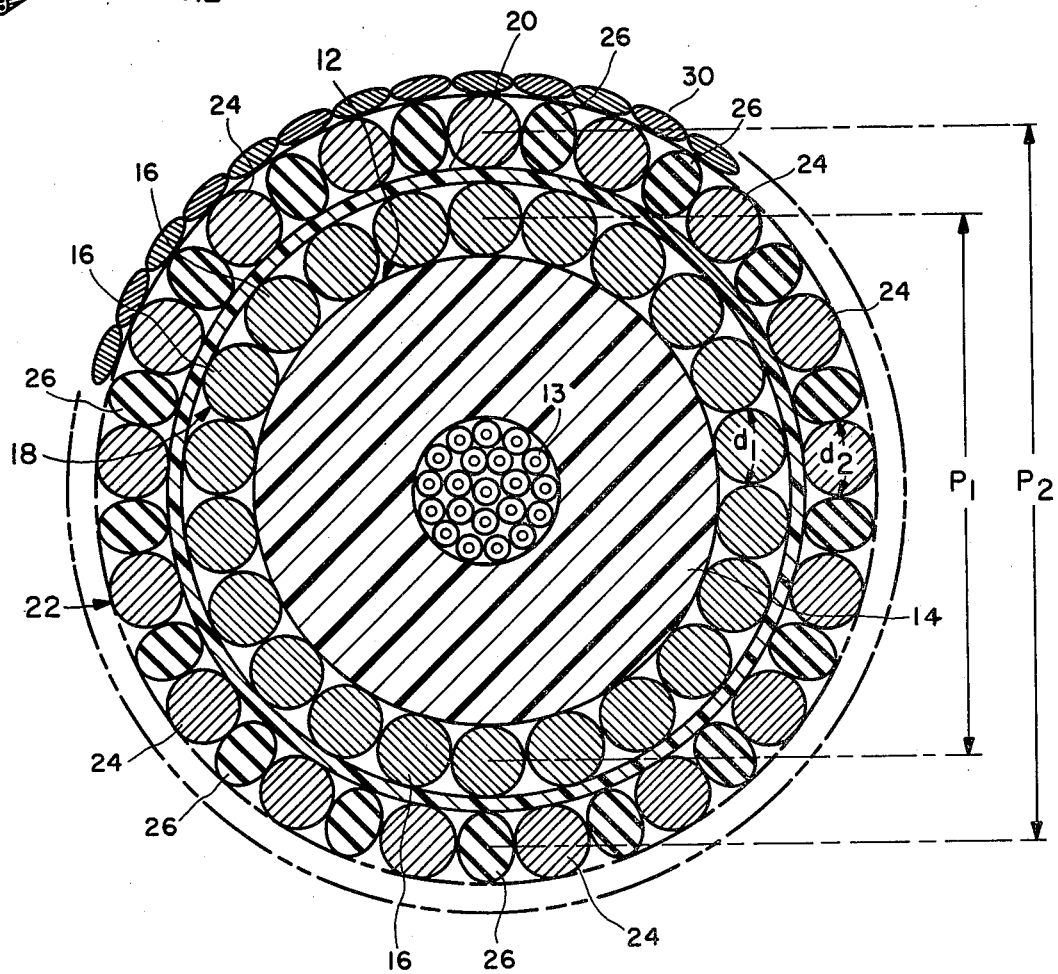
FIG. 2

CONTRAHELICALLY LAID TORQUE BALANCED BENTHIC CABLE

BACKGROUND OF THE INVENTION

This invention relates generally to torque balanced cables, and more particularly to an improved cable useful for towing, suspending, or tethering oceanographic or benthic apparatus or instrumentation.

In the field of oceanography, for example, there are data gathering situations wherein it is desirable to tow or suspend instrumentation at great depths, often measured in hundreds or thousands of meters, and wherein it is advantageous to minimize rotational or angular displacement of instruement stations due to twisting moments or torque developed within the associated cable with changes in loading along the length thereof. In addition, there exists a need for such torque-balanced cables that include signal transmission conductor means such as electrical or fiberoptic conductor means and are strong, lightweight, subject to minimum stretch to assure accuracy of station locations, and sufficiently flexible and durable to permit running over sheaves or around drums during deployment and retrieval.

The development of certain high strength synthetic plastic fiber materials, such as the polyamides, having low coefficients of stretch compared to other synthetic fibers, such the polyethelynes and polyesters, has offered a new dimension in synthetic cable or rope construction. Typical of the polyamide fibers are those sold under the trade name "KEVLAR" by and include "KEVLAR 29" and "KEVLAR 49" having stretch or breaking elongation coefficients of about 3.5% and 2.5%, respectively. One of the greater disadvantages of the polyamide fibers, and one which has presented considerable problems in achieving both flexibility and durability in a cable, is the relatively low resistance to abraision. In this regard "KEVLAR 29" has the better abraision resistance.

Various types of torque free or balanced cables have evolved over the years, each with particular drawbacks. The principal types are braided, parallel fiber, and contrahelically wound. Braided cables are inherently torque balanced but do not exhibit the bending lifetime performance of twisted or contrahelical cables. Parallel fiber cables are torque free but cannot be worked over sheaves. Contrahelically wound cables are aimed at taking advantage of the usually excellent working characteristics of twisted cables, but have not met with good success because of difficulties in obtaining torque balance under differing loads, principally because of differences in the pitch diameters of the strand layers, friction and abrasion between strands and layers, and mismatch of the numbers of strands between layers which will produce the desired balance.

SUMMARY OF THE INVENTION

With the foregoing in mind, it is a principal object of this invention to avoid or overcome most or all of the disadvantages or shortcomings of torque balanced cables, especially but not solely for the purposes mentioned.

One important object of the invention is to provide a substantially torque free cable that is characterized by lightness in weight, resistance to stretch, and adaptability to working around sheaves.

Another important object is the provision of a cable of the foregoing characteristics including electrical and/or optical conductor means.

Still another object is to provide an improved torque balanced cable having durability, flexibility, and reliability over substanial periods of use in the severe environment common to oceanographic instrumentation.

The invention may further be said to reside in certain novel combinations, associations, arrangements of parts, and choices of materials that result in a torque balanced cable that provides the foregoing objects and advantages, as well as others which will become apparent from the below given description of the presently preferred embodiment when read in conjunction with the accompanying sheet of drawings forming a part of this specification.

DESCRIPTION OF THE DRAWINGS

FIG. 1 is a side elevation of a segment of torque balanced cable embodying the present invention, with portions broken away to reveal the inner construction thereof; and FIG. 2 is an enlarged sectional view of the cable taken substantially along line 2—2 of FIG. 1

DESCRIPTION OF THE PREFERRED EMBODIMENT

In the form of the invention illustrated in the drawings and described hereinafter, there is provided a torque balanced cable, indicated generally at 10, which is particularly suitable for use in towing, suspending, or otherwise deploying oceanographic or other bethnic instrumentation. The cable 10 comprises a flexible central core 12 which, in this embodiment includes data transmission means in the form of a bundle 13 of insulated electrical conductors or wires contained in a protective jacket 14. The jacket 14 is made of suitable plastic conveniently extruded over the wire bundle 13. Alternatively, the core 12 may comprise a fiber-optic bundle as a data transmission means. In cases where data transmission is unnecessary, the core 12 may, of course, omit the wire or fiberoptic bundle.

Surrounding the core 12 are a plurality of tension or load bearing strands 16 wound helically to form a first or inner helical layer 18.

The strands 16 of the inner layer 18 are selected to have a diameter or thickness $d_1$ and are provided in a number $n_1$ that will ensure a substantially complete encirclement of the transmission means 13 and its covering 14.

The strands 16 are preferably formed of fibers of a synthetic plastic material that is characterized by high tensile strength and a low stretch factor. The earlier mentioned "KEVLAR" fibers are especially suited for this purpose, and the strands 16 may be impregnated with a material such as polyurethane resin so as to improve their durability under flexing conditions.

The degree of twist in a helical layer of strands is referred to as the pitch angle $\theta$ and is measured relative to the longitudinal axis of the cable. The pitch angle is selected in accordance with known cordage principles and is related to the radius of bend to be imposed on the cable when passing over a sheave. It will be noted from FIG. 1, that the lay of the strands 16 in the layer 18 is right-handed. The diameter of a circle passing through the centers of the strands of a helical layer is referred to as the pitch diameter. In the present embodiment the pitch diameter of the inner layer 18 is indicated at $P_1$.

Over the inner helical layer 18 of KEVLAR fiber strands 16 is wound a layer 20 of a thin plastic film, conveniently in the form of a tape such as is sold under the tradename "MYLAR." The film layer 20 presents smooth, abrasion resistant surfaces to the inner helical strand layer 18 and also to an outer helical strand layer 22. The layer 22 is a composite formed of "KEVLAR" fiber strands 24 alternating with nylon fiber strands 26. The strands 24 are, like the strands 16, load bearing strands having a high resistance to stretch, whereas the nylon fiber strands 26 are relatively stretchy and compliable and hence, substantially non-load bearing. The "KEVLAR" fiber strands 24 have a diameter or thickness $d_2$ that is equal to the diameter or thickness $d_1$ of the strands 16 and are fewer in number, namely 17, for a reason which later will be made apparent. The resiliently compliant nylon strands 26 are of a thickness selected to serve as fillers between the strands 26. The pitch angle $\theta_2$ of the helical lay of the outer layer 22 is equal to the pitch angle $\theta_1$ of the inner layer 18, but of opposite hand. That is to say the lay of the outer layer is left-handed. The pitch diameter of the strands 24 of the outer helical layer is indicated at $P_2$ in FIG. 2.

A braided outer jacket or covering 30 is formed over the outer helical layer 22 for protection thereof from abrasion, fish bite, and to promote ease of handling. The braided jacket is preferably formed of a suitable fiber material such as nylon, "DACRON," or the like.

Cables having contrahelically laid inner and outer layers, such as cable 10, can be characterized by the cable torsional balance ratio, BR, which may be expressed by the standard simplified formula $$BR = \frac{\text{outer layer}}{\text{inner layer}} = \frac{\eta_2\, d_2^2 \sin\theta_2\, P_2}{\eta_1\, d_1^2 \sin\theta_1\, P_1}, \qquad \text{(Eq. 1)}$$

where:

$\eta$=number of strands, d=diameter of strands, $\theta$=angle of lay of the strands, and P=pitch diameter of strand layer.

A balance ratio of unity, of course, would represent a torque balanced condition.

Heretofore, efforts to torque balance by reduction of strand diameter of the outer layer or by reduction in the pitch angle of the outer layer have been counterdicted by loss of strength and resistance to damage in the outer strands by cutting or abrasion, and by a requirement that the outer layer have a larger pitch angle than the inner layer to meet the sheave bending performance thereof.

In accordance with the present invention, the use of a composite outer layer including alternate load bearing and filler strands, as described above, permits the arrival at a balance ratio of substantially unity while maintaining the diameter $d_2$ of the load bearing strands 24 of the outer layer the same as the diameter $d_1$ of the inner layer strands 16. In addition, reduction of the pitch angle $\theta_2$ of the outer layer 22 to equal the pitch angle $\theta_1$ of the inner layer 18 without material degredation of the bending performance of the cable 10 around a sheave, by reason of the compressibility of the filler strands 26. Thus, it will be seen that with $d_1=d_2$, $\theta_1=\theta_2$, and BR set to equal unity for a torque balanced condition, Equation 1 reduces to $$\frac{\eta_2}{\eta_1} = \frac{P_1}{P_2}. \qquad \text{(Eq. 2)}$$

By the way of example, and to better understand the relationships of the elements of the invention, consider a cable 10 wherein a core 12, which will meet the needs of the service to which the cable will be put, has an outside diameter of about 0.6 inch. Selecting a strand size $d_1$ of about 0.1 inch for the strands 16 allows 22 such strands in the layer 18, with a pitch diameter $P_1$ of about 0.70 inch. Setting $d_2$ of strands 24 equal to $d_1$, and with the "MYLAR" layer of about 0.005 inch, a pitch diameter $P_2$ of about 0.91 is arrived at for the outer layer 22. Now, from Equation 2, $$\frac{\eta_2}{22} = \frac{0.70}{0.91},$$

and $\eta_2=16.92$. Accordingly, the nearest full number (17) of "KEVLAR" strands 24 are used in the composite layer 22. With the braided protective layer or jacket 30, the cable 10 has a nominal outside diameter of a little over one inch. The resulting cable 10 is substantially torque free, is sufficiently flexible to run over sheaves or around drums of moderate diameter and, very importantly, the layers 16 and 22 are isolated by the film layer 20 from abrasion against one another when working, as are the individual strands 24 of the outer layer by the filler strands 26.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A torque balanced cable comprising in combination:

a central core means;

an inner strand layer comprising a number of first load bearing strands helically laid about said core means with a predetermined first pitch angle of a first hand and a first pitch diameter;

a composite outer strand layer comprising a number of load bearing second strands helically laid about said inner strand layer with a predetermined second pitch angle substantially equal in magnitude to said first pitch angle but of opposite hand, a second pitch diameter, and a plurality of substantially non-load bearing filler strands disposed alternatively between said second strands;

said first and second load bearing strands being formed of relatively stretch resistant first synthetic fiber material and said filler strands being formed of relatively elastically compliant second synthetic fiber material; and barrier layer means, disposed between said inner and outer strand layers for preventing abrasion therebetween;

said number of first load bearing strands bearing a ratio to said number of second load bearing strands that is substantially porportional to the ratio that said second pitch diameter bears to said first pitch diameter.

2. A torque balanced cable as defined in claim 1, and further comprising:

external jacket means, covering said outer strand layer, for protection of said outer strand layer against damage from cuts and abrasion;

said jacket means ebing formed of a synthetic fiber material having a greater stretch factor than said first synthetic fiber material.

3. A torque balanced cable as defined in claim 2, and wherein:

said first synthetic fiber material comprises an aramid plastic.

4. A torque balanced cable as defined in claim 3, and wherein:

said barrier layer means comprises a synthetic plastic film material presenting smooth, friction reducing surfaces to said inner and outer strand layers.

5. A torque balanced cable as defined in claim 4, and wherein:

said second synthetic fiber material comprises nylon.

6. A torque balanced cable as defined in claim 5, and wherein:

said external jacket means comprises a tubular braid of synthetic fiber strands.

7. A torque balanced cable as defined in claim 6, and wherein:

said tubular braid is formed of nylon fiber strands.

8. A torque balanced cable as defined in claim 7, and wherein:

said central core means comprises signal transmission means.

9. A torque balanced cable as defined in claim 8, and wherein:

said signal transmission means comprises electrically conductive wire means.

10. A torque balanced cable as defined in claim 9, and wherein:

said signal transmission means comprises fiber optic means.

* * * * *